United States Patent [19]

Gick et al.

[11] 3,934,834

[45] Jan. 27, 1976

[54] QUILLER

[76] Inventors: James Edward Gick, 24842 Pylos Way, Mission Viejo; James Walker Gick, 26662 Paseo Ensenada, San Juan Capistrano, both of Calif. 92675

[22] Filed: Aug. 12, 1974

[21] Appl. No.: 496,653

[52] U.S. Cl. ..... 242/67.1 R

[51] Int. Cl.[2] ..... B65H 17/02

[58] Field of Search ..... 242/67.1 R, 55, 74, 60; 93/81 R

[56] References Cited

UNITED STATES PATENTS

| | | | |
|---|---|---|---|
| 158,680 | 1/1875 | Cone | 242/60 |
| 506,913 | 10/1893 | Jobse | 242/60 |
| 790,427 | 5/1905 | Frost | 242/60 |
| 1,285,044 | 11/1918 | Clay | 93/81 R |
| 3,028,112 | 4/1962 | Walker | 242/74 X |

*Primary Examiner*—Stanley N. Gilreath
*Assistant Examiner*—John M. Jillions
*Attorney, Agent, or Firm*—Lawrence D. Sassone

[57] ABSTRACT

A quiller for rolling strips of material into decorative and artistic patterns comprises a body having a flat surface and a crank having a crank axis and coupled to the body so that the crank axis is substantially perpendicular to the flat surface of the body and the crank is rotateable about the crank axis. A pin disposed around a pin axis and having a slot is coupled to the crank and to the body so that the pin axis is substantially coaxial to the crank axis. A strip of material is placed into the slot and wound up by rotating the crank.

2 Claims, 6 Drawing Figures

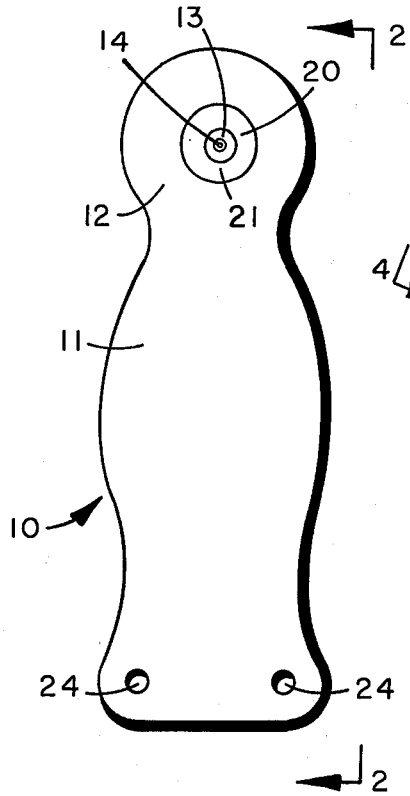
FIG. 1
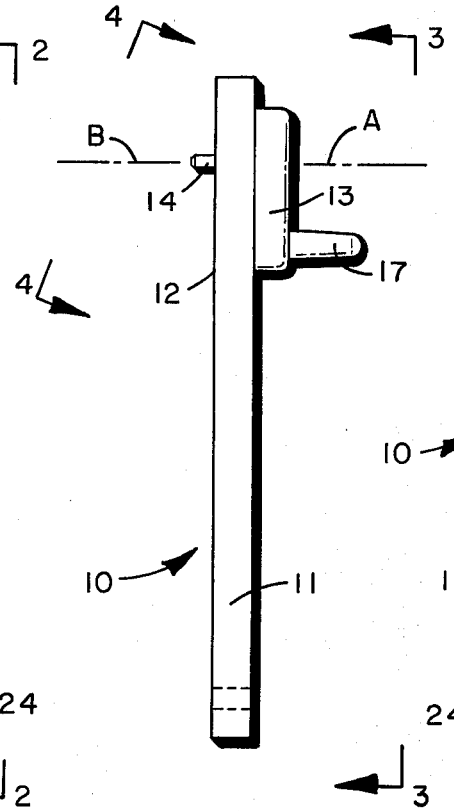
FIG. 2
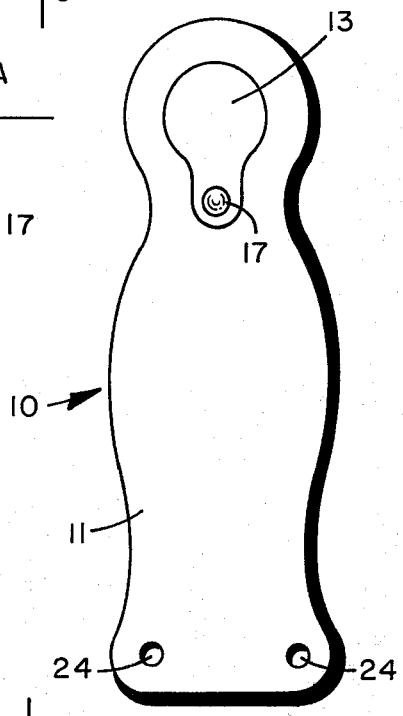
FIG. 3
FIG. 5
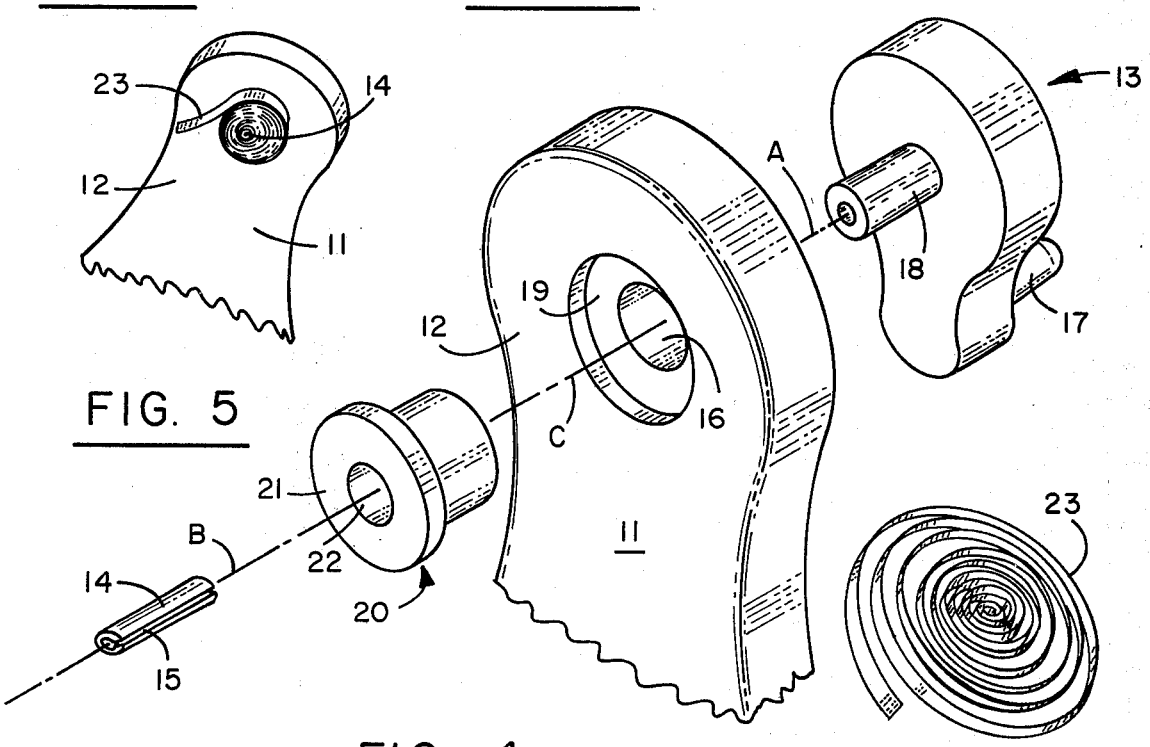
FIG. 4
FIG. 6

QUILLER

BACKGROUND OF THE INVENTION

A quill is a narrow strip of material, usually paper, which has been rolled up. Qulling is the art of rolling narrow strips of material, usually paper, into various shapes and gluing these formed shapes together side by side to create a lacy decorative work of art. The traditional method for rolling strips of paper into decorative and artistic patterns was very slow and tedious with uncertain results. The traditional method required one to hold the tip of the paper between a pin and ones first finger and then to press down with the pin so that the end of the paper would bend up. Then one would push against the end of the paper with his thumb and roll the paper around the pin. The paper by this process would roll toward the end of the finger. When one has rolled to the end of the finger one would have to place his thumb against the paper to keep it from unraveling. The paper would be lifted and moved back down the finger so that it could be rolled the length of the finger again. The thumb holds the paper to the pin so that it cannot unroll during repositioning. One would continue rolling the paper in this manner until the length of the paper is completely wound around the pin. One would have to be very careful to keep the sides of the wound paper straight so that the wound strip of paper would lay flat in one plane. This traditional method was very slow and tedious and resulted in uneven wound strips of paper whose edges did not lie in one plane. The present invention sharply reduces the time for winding a long strip of material and assures that the wound strip of material will lie in a flat plane.

SUMMARY OF THE INVENTION

The present invention relates to a quiller for rolling strips of material into decorative and artistic patterns. It is an object of the invention to provide an apparatus that will be capable of quickly rolling strips of paper and be able to roll successive strips of paper with equal tension each time. It is a further object of the invention to provide an apparatus capable of making strips of material into decorative and artistic patterns.

The quiller for rolling strips of material into decorative and artistic patterns comprises a body having a flat surface and a crank having a crank axis and coupled to the body so that the crank axis is substantially perpendicular to the flat surface of the body and the crank is rotateable about the crank axis and a pin disposed around a pin axis, the pin having a slot and coupled to the crank and to the body so that at least a portion of the pin is above the flat surface of the body and the pin axis is substantially coaxial to the crank axis. It is preferred that the body have a hole through the flat surface of the body and through the body which is capable of receiving a crank having a handle and a shaft disposed around the crank axis. The shaft is mated to the hole of the body and rotateable about the crank axis.

It is further preferred that the body have a recess on the flat surface of the body around the hole of the body and that a bushing disposed around a bushing axis and having a flat surface and a hole be mated to the recess and the hole of the body so that the flat surface of the bushing fits flush with the flat surface of the body and the bushing axis is substantially coaxial to the crank axis. The bushing is rotateable in its mated position about the bushing axis. The shaft is mated to the hole of the body by inserting the shaft into the hole of the bushing.

BRIEF DESCRIPTION OF THE DRAWINGS

FIG. 1 is a front plan view of the quiller;

FIG. 2 is a side elevation view of the quiller;

FIG. 3 is a back plan view of the quiller;

FIG. 4 is an exploded front perspective view of a pin, a bushing, a crank and a fragmentary view of the body of the quiller;

FIG. 5 is a fragmentary front perspective view of the quiller with a quill wound around the pin;

FIG. 6 is a front perspective view of a quill.

DETAILED DESCRIPTION

A quiller 10 for rolling strips of material 23 into decorative and artistic patterns is indicated generally and comprises a body 11 having a flat surface 12 and a hole 16 through the flat surface 12 of the body 11 and a recess 19 on the flat surface 12 of the body 11 around the hole 16 of the body 11 as illustrated in FIGS. 1, 2, 3, 4 and 5.

A bushing 20 disposed around a bushing axis C and having a flat surface 21 and a hole 22 is mated to the recess 19 and the hole 16 of the body 11 so that the flat surface 21 of the bushing 20 fits flush with the flat surface 12 of the body 11 per FIG. 4.

A crank 13 having a crank axis A is coupled to the body 11 so that the crank axis A is substantially perpendicular to the flat surface 12 of the body 11 and the crank 13 is rotateable about the crank axis A as illustrated in FIGS. 1, 2, 3 and 4. It is a preferred embodiment that the crank 13 have a handle 17 and have a shaft 18 disposed around the crank axis A and that the shaft 18 be mated to the hole 16 of the body 11 and rotateable about the crank axis A.

In the embodiment utilizing the bushing 20 the shaft 18 is mated to the hole 16 of the body 11 by inserting the shaft 18 into the hole 22 of the bushing 20. The bushing axis C is substantially coaxial to the crank axis A and the bushing 20 is rotateable about the bushing axis C as illustraated in FIGS. 1 and 4.

A pin 14 disposed around a pin axis B is coupled to the crank 13 and to the body 11 so that at least a portion of the pin 14 is above the flat surface 12 of the body 11 and the pin axis B is substantially coaxial to the crank axis A as shown in FIGS. 1, 2 and 4. The pin 14 has a slot 15 which receives the end of the strip of material 23 as illustrated in FIGS. 2, 4 and 5.

The quiller 10 is assembled by inserting the bushing 20 into the hole 16 of the body 11 then press fitting the shaft 18 into the hole 22 of the bushing 20. The pin 14 may be attached by various means to the crank 13. It is the preferred embodiment that the pin 14 be pressed into the shaft 18 of the crank 13. The quiller and its component parts may be made from plastic, wood or metal or any other suitable material or combination thereof.

A strip of material 23, usually of paper, is rolled into a decorative and artistic pattern by placing the end of the material into the slot 15 of the pin 14. The handle 17 is turned while the strip of material 23 is held against the pin 14 and the edge of the strip of material 23 is held flat against the flat surface 12 of the body 11 and the flat surface 21 of the bushing 20. The handle 17 is turned until all of the length of the strip of material 23 is wrapped around the pin 14 as illustrated in FIG. 5. When the strip of material 23 is completely wrapped around the pin 14 it is removed from the pin 14. The result is a wound strip of paper which may be glued into various shapes or glued to other similarly rolled strips of material into a lacy and decorative design and artistic patterns.

The body further has apertures 24 through the body 11 of the quiller 10 which enables the quiller 10 to receive a fastener, not shown, which can secure the quiller 10 to any desired object.

The quiller 10 may be made from plastic, wood, metal or other suitable materials or combinations thereof.

It is to be understood that the invention is not limited to the exact details of construction, operation, or exact materials or embodiments shown and described, as obvious modifications and equivalents will be apparent to one skilled in the art, and the invention is therefore to be limited only by the scope of the appended claims.

I claim:

1. A quiller for rolling strips of paper into decorative and artistic patterns, comprising:

a body having a flat surface, a hole through the body and through the flat surface of the body and having a recess on the flat surface of the body on one side thereof around the hole of the body;

a cylindrical bushing member having an enlarged shoulder portion on one end thereof adapted to mate with said recess of said body, the cylindrical portion of said bushing extending through said hold of the body and being rotatable therein, the end portion of said bushing member which includes said shoulder portion having a flat surface, said flat surface fitting flush with the flat surface of said body member when said bushing member is disposed in said hole of said body, said bushing member including a hole extending axially therethrough;

a crank having a crank axis, a handle and a shaft disposed around the crank axis wherein the shaft is mated to the hole of the bushing by press fitting the shaft into the hole of the bushing on the other side of said body so that the crank axis is substantially perpendicular to the flat surface of the body and the crank is rotateable about the crank axis; and a pin for winding the paper strips, said pin having an axis and having a slot extending axially therethrough for receiving one end of a paper strip, said pin being coupled to the shaft of the crank by being pressed into the shaft so that at least a portion of the pin is beyond the flat surface of the body.

2. The invention as claimed in claim 1 wherein the body has apertures therethrough for accomodating fasteners for attaching said body to a support.

* * * * *

UNITED STATES PATENT OFFICE

CERTIFICATE OF CORRECTION

Patent No. 3,934,834 Dated January 27, 1976

Inventor(s) James Edward Gick et al.

It is certified that error appears in the above-identified patent and that said Letters Patent are hereby corrected as shown below:

Column 4, line 2 "hold" should read -- hole --.

Column 4, line 23, before the period insert -- and the pin axis is substantially coaxial to the crank axis --.

Signed and Sealed this twentieth Day of April 1976

[SEAL]

Attest:

RUTH C. MASON
*Attesting Officer*

C. MARSHALL DANN
*Commissioner of Patents and Trademarks*